US005599114A

United States Patent [19]

Sugahara et al.

[11] Patent Number: 5,599,114

[45] Date of Patent: Feb. 4, 1997

[54] PRINTING CONTROL METHOD AND PRINTER

[75] Inventors: Yoshinori Sugahara, Kawasaki; Kouhei Yachi, Kanazawa; Hajime Ishiguro, Kawasaki; Takashi Murotani, Kanazawa, all of Japan

[73] Assignee: Fujitsu Limited, Kawasaki, Japan

[21] Appl. No.: 514,858

[22] Filed: Aug. 14, 1995

[30] Foreign Application Priority Data

Nov. 28, 1994 [JP] Japan ..... 6-292803
May 30, 1995 [JP] Japan ..... 7-132303

[51] Int. Cl.[6] ..... B41J 2/30

[52] U.S. Cl. ..... 400/124.04; 400/279; 400/582

[58] Field of Search ..... 400/124.04, 279, 400/582

[56] References Cited

FOREIGN PATENT DOCUMENTS 60-16351 1/1979 Japan ..... 400/124
57-176176 10/1982 Japan ..... 400/124
60-38166 2/1985 Japan ..... 400/124
60-255449 12/1985 Japan ..... 400/124
62-177622 8/1987 Japan .

*Primary Examiner*—John S. Hilten
*Attorney, Agent, or Firm*—Nikaido, Marmelstein, Murray & Oram LLP

[57] ABSTRACT

In the method, lines are printed on a sheet using a head unit, the lines having a pitch larger than a printing width of the head unit, the printing width being a width along a first direction. In the method, using the head unit, a first part of a first line is printed on the sheet along a second direction perpendicular to the first direction. A relative position of the head unit with reference to the sheet is moved along the first direction a distance equal to the printing width of the head unit. Using the head unit, a remaining part of the first line and at least a first part of a second line is printed on the sheet along the second direction. The relative position of the head unit with reference to the sheet is moved along the first direction a slight distance equal to or shorter than the printing width of the head unit. Using the head unit, a predetermined part of the second line is printed on the sheet along the second direction, the predetermined part including the first part of the second line.

9 Claims, 14 Drawing Sheets

PRINTING CONTROL METHOD AND PRINTER

BACKGROUND OF THE INVENTION

1. Field of the Invention

The present invention relates to a printing control method and a printer, and, in particular, to a printing control method and a printer in which high-quality printing can be achieved even if a sheet feed accuracy for a line feed is relatively low.

2. Description of the Related Art

In a printer such as an impact printer, ideally, a head printing width along a direction perpendicular to a head scanning direction is equal to a pitch of lines printed on a sheet. The term 'head printing width' is referred to as the maximum width the head can print. Specifically, in FIG. 1, a printing width 'H' of the head along a Y direction is equal to a pitch 'L' of lines along the Y direction. In such a case, ordinarily, a mechanism for feeding a sheet one line for a line feed can feed the sheet in a sufficiently high accuracy. Therefore, even if each of heights, along the Y direction, of letters or the like printed on a first line and a second line is equal to the pitch 'L' of lines, no gap appears in which nothing is printed between the first and second lines. Thus, high-quality printing can be achieved.

However, the head printing height 'H' is not always equal to the line pitch 'L'. This is because, ordinarily, a printer has only one head provided therein and therefore the head printing width 'H' is fixed for the particular printer. However, in a host control apparatus including a central processing unit (CPU) or the like supplying a printing command and printing data to the printer, a printing format or the like can be freely modified as a result of modifying relevant software. Specifically, by modifying the software in the host control apparatus, independent of the head printing width 'H' of the printer, the line pitch 'L' and a size of a letter can be freely set and then the printing data is printed according to the set condition. Thereby, printing of a magnified letter having a size, for example, twice, vertically and horizontally, the standard size, printing of various figures, various images, printing of a bar code which extends over several lines, and so forth can be performed. However, when the line pitch 'L' is larger than the head printing width 'H' a plurality of scanning operations of the head along the scanning direction 'X' are required for printing one line.

FIGS. 2A and 2B show a printing control method which may be used for such a case. Hatched boxes shown in FIG. 2A indicate letters, bar codes and so forth printed on a sheet. The head prints a part of a first line with a width 'H1' (='H') shown in FIG. 2A in a first scanning operation. Then, the sheet is fed the width 'H1', and then the head prints the remaining part of the first line and a part of a second line with a width 'H2' (='H') shown in FIG. 2A in a second scanning operation. Then the sheet is fed a slight width such that the head may scan the sheet from the top of the second line. Then, the head prints a part of the second line with a width 'H3' (='H') shown in FIG. 2A in a third scanning operation. At the time, because a part of the second line was already printed in the second scanning operation of the head, in the third scanning operation of the head with the width 'H3', only a part remaining of the second line after the printing in the second scanning operation is printed. As a result of the first, second and third scanning operations with the widths 'H1' 'H2' and 'H3' a width shown in FIG. 2B is scanned. In FIG. 2B, 'P1', 'P2', and 'P3' indicate widths which the head prints in the first, second and third scanning operations, respectively.

In one example, the width 'H' corresponds to 24 dots, the width which the sheet is fed between the first and second scanning operations is $^{18}/_{120}$ inches, and the slight width which the sheet is fed between the second and third scanning operations is $^{2}/_{120}$ inches.

The sheet is fed through a sheet feed mechanism. An operation by which the sheet is fed by one line for a line feed and an operation by which the sheet is fed the head width 'H' can be performed with relatively high accuracy by the sheet feed mechanism because a width which the sheet is fed is relatively large. However, the above-mentioned slight width which the sheet is fed immediately before the third scanning operation is a very small width in comparison to the width in the case of an ordinary line feed or the like. Feeding the sheet such a very small width through the sheet feed mechanism with a high accuracy is mechanically difficult. Actually, some extent of error is likely to occur.

If such an error occurs and thus, in the example of FIG. 2A, the sheet is fed a width larger than the correct width by an extra width 'E' shown in the figure, the head then performs the third scanning operation with the width 'H3' from a position, indicated by a broken line shown in FIG. 2A, slightly lower than the top of the second line. In this case, a top part of the second line was already printed in the second scanning operation of the head. However, the printing of the width indicated by 'P3' shown in FIG. 2B is performed from a position lower by the error 'E'. As a result, a gap 'G' in which nothing is printed appears along the head scanning direction 'X' within the actually printed letter, bar code and so forth. Such a gap 'G' appears in each of cases where the head performs fourth and fifth scanning operations with widths 'H4' and 'H5' for the same reason. In this example, the error 'E' corresponds to 1 or a plurality of dots.

Such a gap 'G' appears due to an inaccuracy which occurs because the sheet is fed only slightly. Therefore, this problem does not occur only for the impact printer. In principle, the same problem may occur in various printers such as an ink-jet printer, a thermal printer and so forth.

When such a gap 'G' appears, not only is printing quality degraded but also a large problem occurs, in particular, in a case where a bar code is printed. Specifically, if the gap 'G' such as that shown in FIG. 2A appears in the printed bar code, when the bar code is read by a bar-code reader and the gap 'G' is accidentally scanned horizontally at this time, the bar-code reader cannot determine the presence of the bar code and thus a correct reading of the bar code cannot be performed.

Thus, the bar code cannot be correctly read when a gap or the like is present in the bar code along the horizontal direction, that is, the bar-code reader scanning direction. Therefore, high quality is required in printing the bar code. A printer must be very useful, relatively inexpensive and able to print the bar code without using an especially advanced thus costly printing technology. Therefore, development of a printer is demanded, which printer can solve the above-described problem and can print even such a bar code with a high printing quality.

Further, the above-described gap not only causes a problem in a case of bar code printing but also in cases of printing a magnified letter, various figures, and various images. If such a horizontally extending gap appears in the latter cases, a printing quality may be degraded.

SUMMARY OF THE INVENTION

An object of the present invention is to provide a printing method and a printer in which, such a non-printed gap extending along a head scanning direction does not appear and thus high quality printing can be achieved, even if a sheet feed accuracy is relevant low.

A printing method, according to the present invention, for printing lines on a sheet using a head unit, said lines having a pitch larger than a printing width of said head unit, said printing width being a width along a first direction, comprises steps of:

a) printing using said head unit on said sheet a first part of a first line along a second direction perpendicular to said first direction;

b) moving a relative position of said head unit with reference to said sheet along said first direction a distance equal to said printing width of said head unit;

c) printing using said head unit on said sheet a remaining part of said first line and at least a first part of a second line along said second direction;

d) moving said relative position of said head unit with reference to said sheet along said first direction a slight distance equal to or shorter than said printing width of said head unit; and e) printing using said head unit on said sheet a predetermined part of said second line along said second direction, said predetermined part including said first part of said second line.

In another aspect of the present invention:

said relative position of said head unit with reference to said sheet moves a distance longer than a predetermined distance 'M' along said first direction in an ordinary line feed case, said printing width of said head unit being expressed by N=M−C, where M>N>C and 'C' indicates a correction width along said first direction; and said method further comprises steps of:

f) determining, when a first printing operation is performed, that a printing starting position of said head unit is to be a top of said first line and said printing width is to be equal to 'N';

g) determining, when a not-yet-printed pattern in a memory is moved to a free area of said memory, that a moving object is to be one starting from a top of said not-yet-printed pattern of said first line and a moving object length is to be a not-yet-printed width of said first line;

h) determining, when a top printing pattern in said second line is copied to a free area of said memory, that a copy object is to be one starting from a top of said second line and a copy destination is to be a position resulting from adding said not-yet-printed width of said first line to a top of said not-yet-printed pattern of said first line which was moved, and a copy object length is to be 'C'; and i) determining, when a second printing operation is performed, that a printing starting position is to be one resulting from subtracting said not-yet-printed width of said first line from a top of a subsequent line, and a line feed rate of said head unit is to correspond to said not-yet-printed width of said first line.

Thereby, appearance of a gap in which nothing is printed along the second direction can be surely prevented. Therefore, even though an accuracy at which a sheet feeding mechanism of the printer for a line feed is unstable due to some reason, or is degraded as a result of the printer having been used for a long period, appearance of such a gap can be prevented and thus printing quality can be improved. As a result, it is possible to maintain for a long time a high printing accuracy of the printer. Further, if a gap appears in a bar code along a scanning direction of a bar code reader, it is not possible to accurately read the bar code. Therefore, high quality is required for printing the bar code. According to the present invention, without requiring advanced printing, such a bar code can be printed in a relatively inexpensive printer. Thus, it is very advantageous.

In another aspect of the present invention;

said relative position of said head unit with reference to said sheet moves a distance equal to a predetermined distance 'M' along said first direction in an ordinary line feed case, 'C' indicates a correction width along said first direction, 'L' indicates a printable maximum width along said second direction in each line, and M>C; and said method further comprises steps of:

f) developing in a memory a predetermined number of lines of printing patterns, said predetermined number of lines starting from a specified top line or a top of said sheet;

g) printing 'M' of said printing patterns from a top of said specified first line in a first printing operation, and performing a line feed of said head unit to a top of a subsequent line;

h) copying a size of along-said-first-direction (vertical) 'C' by along-said-second-direction (horizontal) 'L' of said printing patterns which have not been printed in said first printing operation, to a position, in said memory, resulting from subtracting 'C' from a top of said printing patterns which have not been printed in said step g);

i) developing printing patterns of a second line in said memory; and j) printing said printing patterns produced in said steps h and i in a second printing operation and performing a line feed of said head unit to a top of a subsequent line, so as to performing printing to fill in a gap which may appear due to a possible error occurring in said line feed in said step g.

In anther aspect of the present invention:

said relative position of said head unit with reference to said sheet moves a distance equal to a predetermined distance 'M' along said first direction in an ordinary line feed case, said printing width of said head unit along said first direction being expressed by N=M, 'L' indicates a printable maximum width along said second direction in each line, 'C' indicates a correction width along said first direction, and and M>C; and said method further comprises steps of:

f) developing in a memory a predetermined number of lines of printing patterns, said predetermined number of lines starting from a specified top line or a top of said sheet;

g) printing 'M' of said printing patterns from a top of said specified first line in a first printing operation, and performing a line feed of said head unit by a distance of a length resulting from subtracting 'C' from 'M';

h) copying a size of along-said-first-direction (vertical) 'C' by along-said-second-direction (horizontal) 'L' of said printing patterns which have not been printed in said first printing operation, to a position, in said memory, resulting from subtracting 'M' from a top of said printing patterns which have not been printed in said step g), and further to a position resulting from subtracting 'M' from a top of said printing patterns which have not been printed in said step g) and adding 1 thereto;

i) printing said printing patterns produced in said step h in a second printing operation and performing a slight line feed of said head unit by a distance equal to 'C' so as to perform printing to fill in a gap which may appear due to a possible error occurring in said line feed in said step g and further fill in a gap which may appear due to a possible error occurring in said slight line feed in said step i;

j) developing printing patterns of a second line in said memory; and k) printing said second line similar to a manner in which said first line was printed.

Thereby, it is possible to reduce, to the limit, processes of copying to a turnout area dot patterns developed in the memory in the printing operation, delete dot patterns developed in the memory, and return (move) dot patterns previously copied to the turnout area. As a result, high-speed printing can be achieved.

A printer according to another aspect of the present invention comprises:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein said control means, when lines are printed, said lines having a pitch larger than a printing width along said first direction, causes said head unit to print on said sheet a first part of a first line along said second direction;

causes said mechanism to move said relative position of said head unit with reference to said sheet along said first direction a distance equal to said printing width of said head unit;

causes said head unit to print on said sheet a remaining part of said first line and at least a first part of a second line along said second direction;

causes said mechanism to move said relative position of said head unit with reference to said sheet along said first direction a slight distance equal to or shorter than said printing width of said head unit; and causes said head unit to print on said sheet a predetermined part of said second line along said second direction, said predetermined part including said first part of said second line.

Thereby, appearance of a gap in which nothing is printed along the second direction can be surely prevented. Therefore, even though an accuracy at which a sheet feeding mechanism of the printer for a line feed is unstable due to some reason, or is degraded as a result of the printer having been used for a long period, appearance of such a gap can be prevented and thus printing quality can be improved. As a result, it is possible to maintain for a long time a high printing accuracy of the printer. Further, if a gap appears in a bar code along a scanning direction of a bar code reader, it is not possible to accurately read the bar code. Therefore, high quality is required for printing the bar code. According to the present invention, without requiring advanced printing, such a bar code can be printed in a relatively cheep printer. Thus, it is very advantageous.

In another aspect of the present invention, the printer further comprises memory means;

wherein said control means, when said remaining part of said first line and said at least a first part of said second line are printed, stores in said memory means only part of said data of said first part of said second line, which part of data is used for printing in an overlapping manner, and deletes a remaining part of said data.

Thereby, it is possible to perform gap correction in a relatively simple composition.

In another aspect of the present invention, a printer comprises:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein, in a case where said relative position of said head unit with reference to said sheet moves a distance longer than a predetermined distance 'M' along said first direction in an ordinary line feed case, said printing width of said head unit being expressed by N=M−C, where M>N>C and 'C' indicates a correction width along said first direction;

said control means:

determines, when a first printing operation is performed, that a printing starting position of said head unit is to be a top of a first line and a printing length is to be equal to 'N';

determines, when a not-yet-printed pattern in memory means is moved to a free area of said memory means, that a moving object is to be one starting from a top of said not-yet-printed pattern of said first width of said first line;

determines, when a top printing pattern in a second line is copied to a free area of said memory means, that a copy object is to be one starting from a top of said second line and a copy destination is to be a position resulting from adding said not-yet-printed width of said first line to a top of said not-yet-printed pattern of said first line which was moved, and a copy object length is to be 'C'; and determines, when a second printing operation is performed, that a printing starting position is to be one resulting from subtracting said not-yet-printed width of said first line from a top of a subsequent line, and a line feed rate of said head unit is to correspond to said not-yet-printed width of said first line.

In another aspect of the present invention, a printer comprises:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein, in a case where said relative position of said head unit with reference to said sheet moves a distance equal to a predetermined distance 'M' along said first direction in an ordinary line feed case, said printing width 'N', along said first direction, of said head unit being expressed by N>M, 'C' indicating a correction width along said first direction, 'L' indicating a printable maximum width along said second direction in each line, and M>C;

said control means comprises:

first means for developing in memory means a predetermined number of lines of printing patterns, said predetermined number of lines starting from a specified top line or a top of said sheet;

second means for printing 'M' of said printing patterns from a top of said specified first line in a first printing operation, and performing a line feed of said head unit to a top of a subsequent line;

third means for copying a size of along-said-first-direction (vertical) 'C' by along-said-second-direction (horizontal) 'L' of said printing patterns which have not been printed in said first printing operation, to a position, in said memory means, resulting from subtracting 'C' from a top of said printing patterns which have not been printed by said second means;

fourth means for developing printing patterns of a second line in said memory means; and fifth means for printing said printing patterns produced by said third and fourth means in a second printing operation and performing a line feed of said head unit to a top of a subsequent line, so as to performing printing to fill in a gap which may appear due to a possible error occurring in said line feed by said second means.

In another aspect of the present invention, a printer comprises:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein, in a case where said relative position of said head unit with reference to said sheet moves a distance equal to a predetermined distance 'M' along said first direction in an ordinary line feed case, said printing width of said head unit along said first direction being expressed by N=M, 'L' indicating a printable maximum width along said second direction in each line, 'C' indicating a correction width along said first direction, and and M>C;

said control means comprises:

first means for developing in memory means a predetermined number of lines of printing patterns, said predetermined number of lines starting from a specified top line or a top of said sheet;

second means for printing 'M' of said printing patterns from a top of said specified first line in a first printing operation, and performing a line feed of said head unit by a distance of a length resulting from subtracting 'C' from 'M';

third means for copying a size of along-said-first-direction (vertical) 'C' by along-said-second-direction (horizontal) 'L' of said printing patterns which have not been printed in said first printing operation, to a position, in said memory means, resulting from subtracting 'M' from a top of said printing patterns which have not been printed by said second means, and further to a position resulting from subtracting 'M' from a top of said printing patterns which have not been printed by said second means and adding 1 thereto;

fourth means for printing said printing patterns produced by said third means in a second printing operation and performing a slight line feed of said head unit by a distance equal to 'C' so as to performing printing to fill in a gap which may appear due to a possible error occurring in said line feed by said second means and further fill in a gap which may appear due to a possible error occurring in said slight line feed by said fourth means;

fifth means for developing printing patterns of a second line in said memory means; and sixth means for printing said second line similar to a manner in which said first line was printed.

Thereby, it is possible to reduce, to the limit, processes of copying to a turnout area dot patterns developed in the memory in the printing operation, delete dot patterns developed in the memory, and return (move) dot patterns previously copied to the turnout area. As a result, high-speed printing can be achieved.

Therefore, according to the present invention, without requiring a high sheet feed accuracy, appearance of a gap, in which nothing is printed, extending along a head scanning direction can be prevented. Thus, it is possible to achieve high quality printing.

Other objects and further features of the present invention will become more apparent from the following detailed description when read in conjunction with the accompanying drawings.

DESCRIPTION OF PREFERRED EMBODIMENTS

Figure 3:
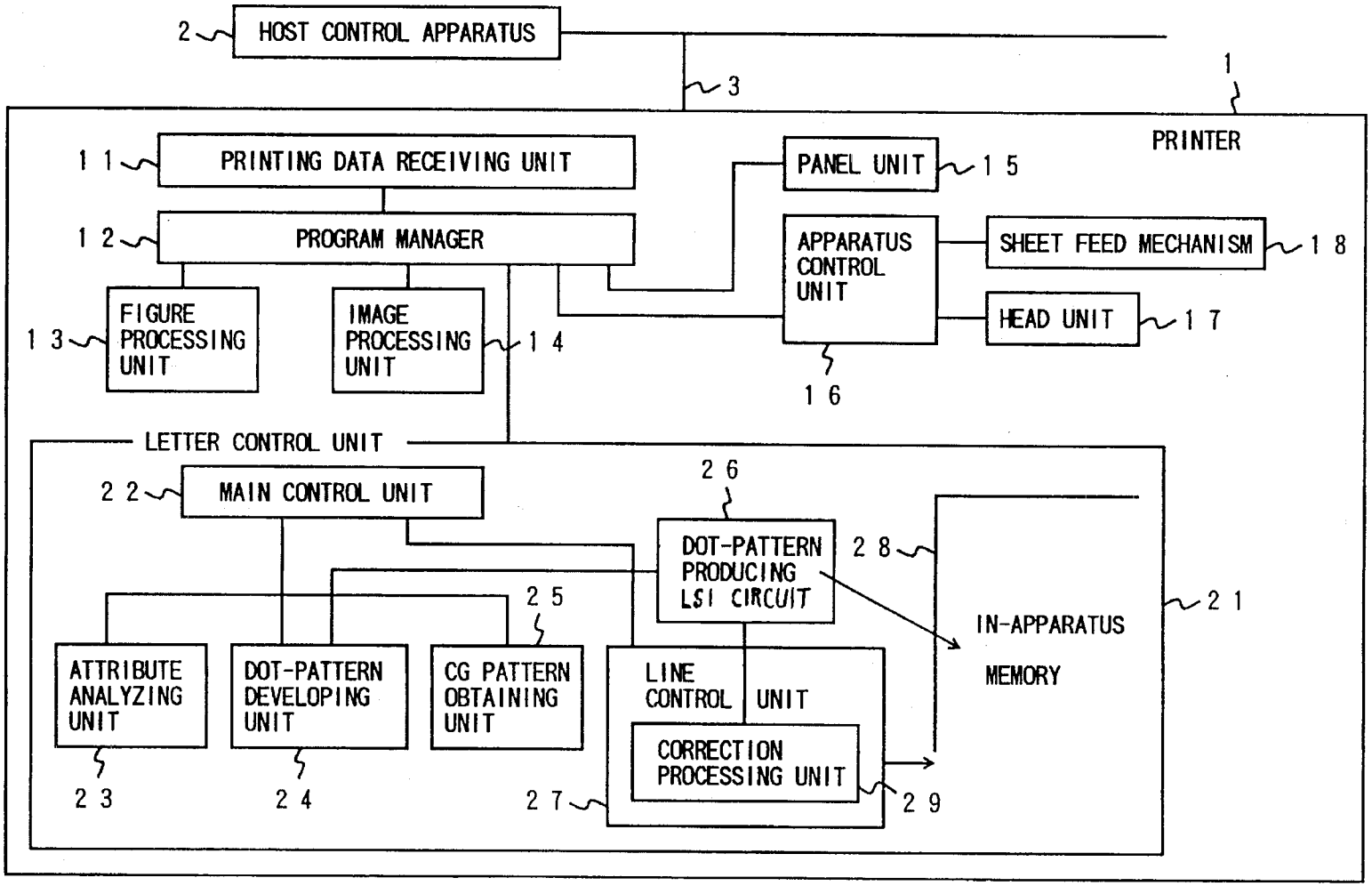
FIG. 3 shows a block diagram of a first embodiment of a printer according to the present invention.

FIG. 3 shows a block diagram of a first embodiment of a printer according to the present invention. The first embodiment of the printer uses a first embodiment of a printing method according to the present invention. The printer 1 is connected with a host control apparatus via a serial interface 3.

In general, the printer 1 includes a printing data receiving unit 11, a program manager 12, a figure processing unit 13, an image processing unit 14, a panel unit 15, an apparatus control unit 16, a head unit 17, a sheet feed mechanism 18, a letter control unit 21. The letter control unit 21 includes a main control unit 22, an attribute analyzing unit 23, a dot-pattern developing unit 24, a computer graphics (CG) pattern obtaining unit 25, a dot-pattern producing large-scaled integrated (LSI) circuit 26, a line control unit 27, and an in-apparatus memory 28. The line control unit 27 includes a correction processing unit 29.

The printing data receiving unit 11 receives printing data from the host control apparatus 2 via the serial interface 3, supplies the data to the program manager 13, and sends information indicating an operation state of the printer 1 to the host control apparatus 2 via the serial interface 3. The printing data includes figure data, image data, letter data, and so forth.

The program manager 12 manages programs for various operations of the printer 1, which manager selects a program and a processing unit relevant to received data and controls the data using the selected program. Specifically, the program manager 12 controls the figure processing unit 13 in accordance with a figure processing program if the printing data is figure data. The manager 12 thus develops (converts) the figure data into data suitable for a printing format of the printer 1. The manager 12 controls the image processing unit 14 in accordance with an image processing program if the printing data is image data. The manager 12 thus develops the image data into data suitable for the printing format of the printer 1. The manager 12 controls the letter control unit 21 if the printing data is letter data. The manager 12 thus develops the letter data into data suitable for the printing format of the printer 1.

The data which is developed by the figure processing unit 13, the image processing unit 14 or the letter control unit 21 may be developed in a bit-map memory included in a relevant unit. However, in the first embodiment, as an example, the data is developed on the in-apparatus memory 28 via the dot-pattern producing LSI circuit 26. The data developed in the in-apparatus memory 28 is transferred to the head unit 17 via the apparatus control unit 16. The head unit 17, having, for example, an impact printing head, prints out the data transferred from the apparatus control unit 16 onto a sheet through a well-known method. The sheet feed mechanism 18 feeds a sheet a predetermined width in a case of an ordinary line feed and in a case of a slight line feed which will be described later.

The panel unit 15 includes switches and so forth for selecting one from among various operations of the printer 1, and a display unit for displaying a current state and so forth of the printer 1. When an operation is selected through a switch of the panel unit 15, the program manager 12 is informed of the selected operation.

Part, of the printer 1, itself consisting of the printing data receiving unit 11, program manager 12, figure processing unit 13, image processing unit 14, panel unit 15, apparatus control unit 16, head unit 17, and sheet feed mechanism 18, may be of a well-known arrangement. Therefore, a detailed description thereof will be omitted.

In the letter control unit 21, the main control unit 22 controls each unit included in the letter control unit 21. The attribute analyzing unit 23, under the control of the main control unit 22, analyzes letter data obtainable via the program manager 12, and thus controls a magnification of each letter and so forth. The dot-pattern developing unit 24, under the control of the main control unit 22, draws in the in-apparatus memory 28 (bit-map memory) dot patterns of specified letter codes in specified rectangular sizes. The CG pattern obtaining unit 25, under the control of the main control unit 22, retrieves the dot patterns of letter codes specified by the letter data from the in-apparatus memory 28.

The dot-pattern producing LSI 26 develops the dot patterns, obtained by the CG pattern obtaining unit 25, in the in-apparatus memory 28 (bit-map memory). The line control unit 27, under the control of the main control unit 22, performs a control operation for printing the developed letter data at a specified line feed rate. The correction processing unit 29 in the line control unit 27 corrects errors occurring in a calculation of the line feed rate.

Part of the letter control unit 21, itself consisting of the main control unit 22, attribute analyzing unit 23, dot-pattern developing unit 24, CG pattern obtaining unit 25, line control unit 27 and in-apparatus memory 28, may be of a well-known arrangement. Therefore, a detail of description thereof will be omitted.

Figure 4B:
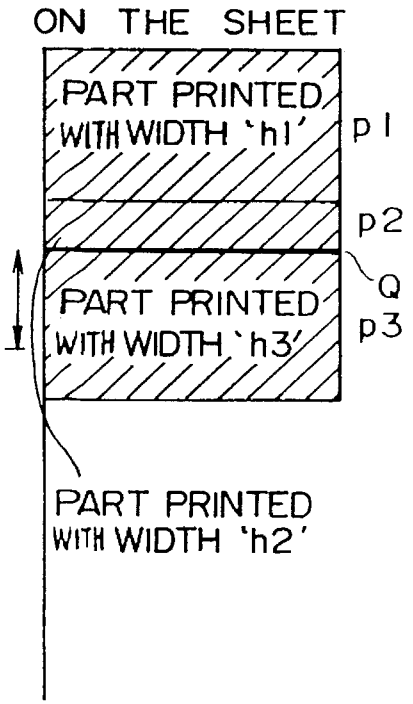
FIGS. 4A and 4B illustrate an operation of the first embodiment.

An operation of the first embodiment will now be described with reference to FIGS. 4A and 4B. The figures show a case where the line pitch 'L' is larger than the head printing width 'H' of the head unit 17, and thus a plurality of scanning operations of the head along the scanning direction are required for printing each line.

Figure 4A:
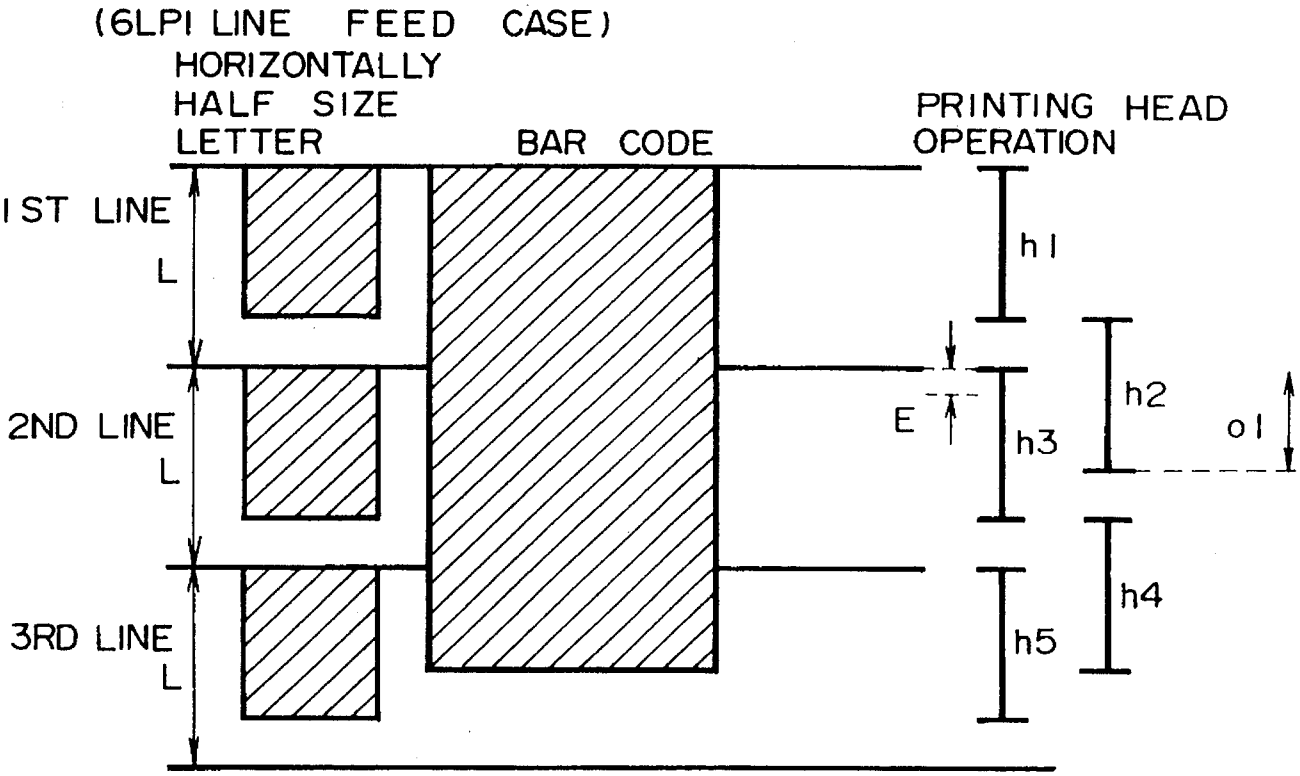

Hatched boxes shown in FIG. 4A indicate letters, bar codes and so forth printed on a sheet. The head unit 17 prints a part of a first line with a width 'h1' (='H') shown in FIG. 4A in a first scanning operation. Then, the sheet is fed the width 'h1' and then the head unit 17 prints the remaining part of the first line and a part of a second line with a width 'h2' (='H') shown in FIG. 4A in a second scanning operation. Then the sheet is fed a slight width such that the head may scan the sheet from the top of the second line. Then, the head prints a part of the second line with a width 'h3' (='H') shown in FIG. 4A in a third scanning operation. At the time, a part of the second line was already printed in the second scanning operation of the head unit 17. In the third scanning operation of the head unit 17 with the width 'h3' the part which was printed in the second scanning operation with the width 'h2' as well as a part remaining of the second line after the printing in the second scanning operation are printed with the width 'h3'. As a result of the first, second and third scanning operations with the widths 'h1' 'h2' and 'h3' a width shown in FIG. 4B is scanned In FIG. 4B, 'p1', 'p2', and 'p3' indicate widths which the head unit 17 prints in the first, second and third scanning operations, respectively, and 'o1' indicates a maximum width which is printed in both of the second and third scanning operations of the head unit 17.

In one example, the width 'H' corresponds to 24 dots, the width which the sheet is fed between the first and second scanning operations is 18/120 inches, and the slight width which the sheet is fed between the second and third scanning operations is 2/120 inches.

The sheet is fed through the sheet feed mechanism 18. An operation by which the sheet is fed by one line for a line feed and an operation by which the sheet is fed a distance corresponding to the head width 'H' can be performed with relatively high accuracy by the sheet feed mechanism 18 because a width which the sheet is fed is relatively large. However, the above-mentioned slight width which the sheet is fed immediately before the third scanning operation is a very small width in comparison to the width in the case of an ordinary line feed or the like. Feeding the sheet such a very small width (distance) through the sheet feed mechanism 18 with a high accuracy is mechanically difficult. Actually, some extent of error is likely to occur.

If such an error occurs and thus, in the example of FIG. 4A, the sheet is fed a width (distance) larger than the correct width by an extra width 'E' shown in the figure, the head unit 17 then performs the third scanning operation with the width 'h3' from a position slightly lower than the top of the second line. In this case, a top part of the second line was already printed in the second scanning operation of the head unit 17. Further, the printing of the width indicated by 'p3' shown in FIG. 4B is performed from a position lower by the error 'E'. However, the third scanning operation with the width 'h3' is performed over the part which was printed in the second scanning operation with the width 'h2'. Therefore, a gap in which nothing is printed does not appear horizontally, that is, along the head unit 17 scanning direction 'X' within each of the actually printed letters, bar codes and so forth. Such a gap does not appear in each of cases where the head unit 17 performs fourth and fifth scanning operations with widths 'h4' and 'h5' for the same reason.

Appearance of such a gap results from a low accuracy with which the sheet is fed slightly. Therefore, this problem does not occur only for the impact printer. In principle, the same problem may occur in various printers such as an ink-jet printer, a thermal printer and so forth.

Figure 1:
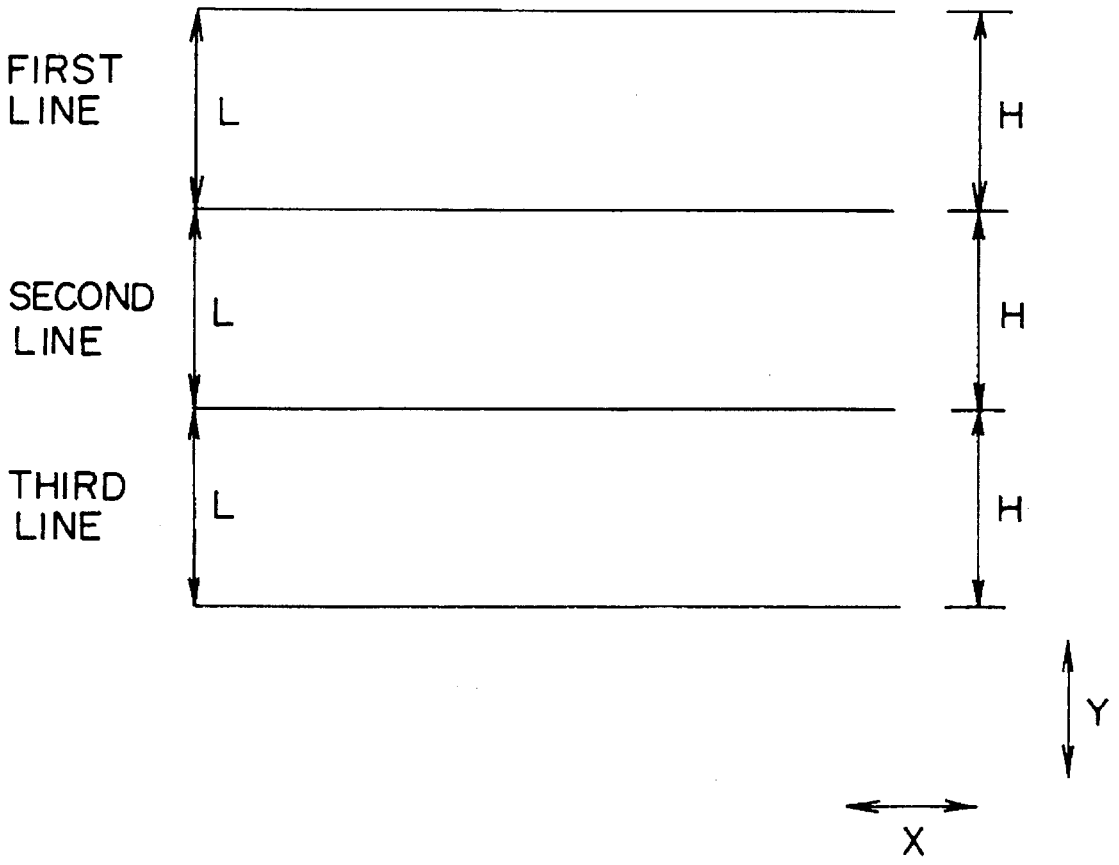
FIG. 1 illustrates a printing operation in a case where a printing width, along a direction perpendicular to a head scanning direction, of a head is equal to a pitch of lines printed on a sheet.
Figure 2A:
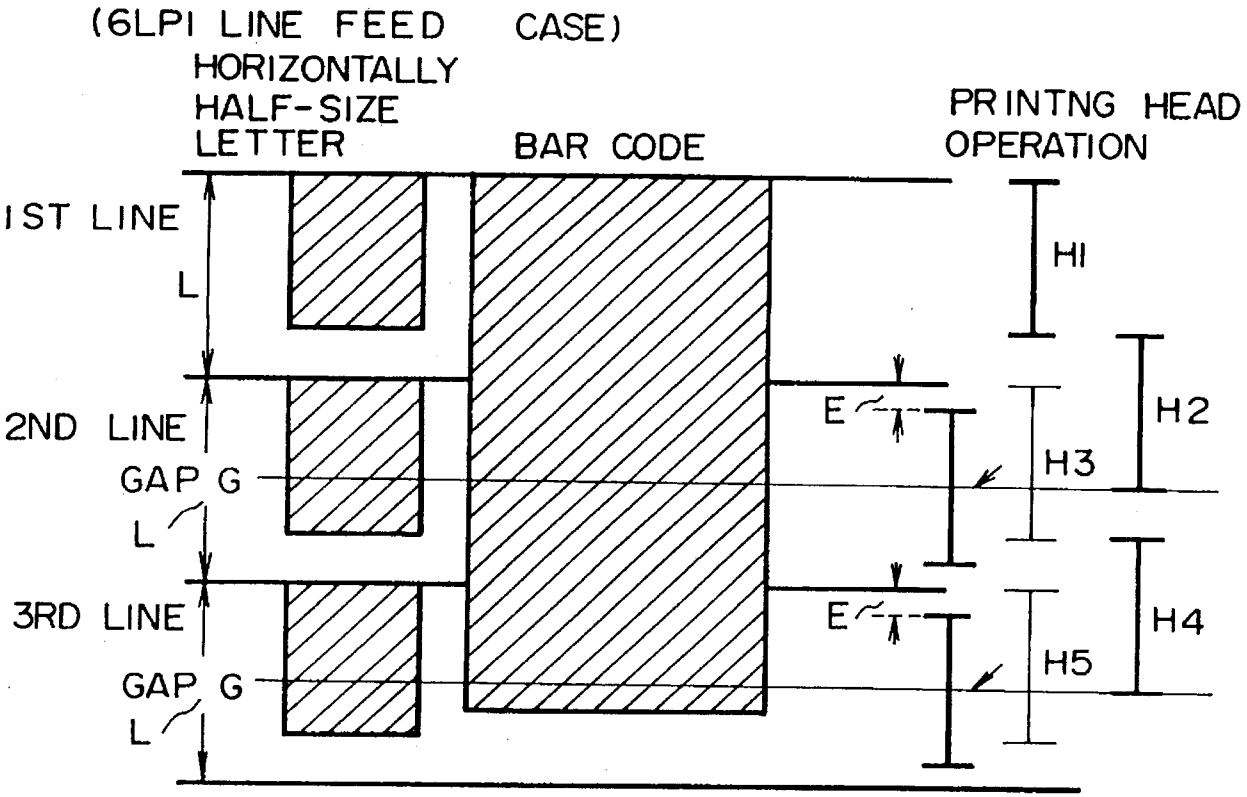
FIGS. 2A and 2B show a possible printing control method.
Figure 2B:
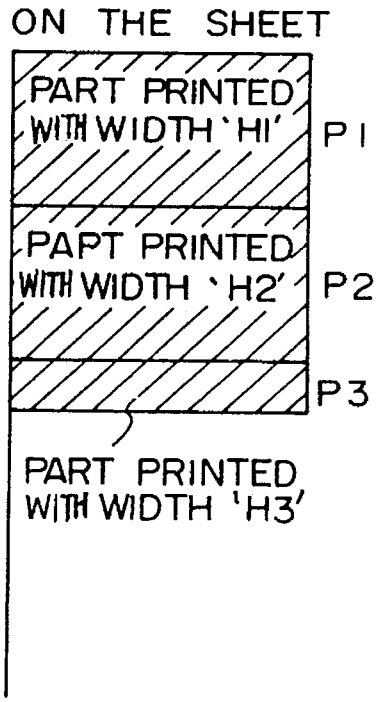

In the first embodiment, such a gap 'G' appearing in the case shown in FIG. 2A does not appear even if an error such as the above-mentioned error 'E' occurs. Therefore, degradation of a printing quality can be prevented. Specifically, if the gap 'G' such as that shown in FIG. 2A appears in a printed bar code, when the bar code is read by a bar-code reader and the gap 'G' is by chance scanned horizontally at this time, the bar-code reader cannot determine the presence of the bar code and thus correct reading of the bar code cannot be performed. However, by using the first embodiment, occurrence of such a problem can be prevented.

Such a bar code cannot be correctly read when such a gap or the like is present extending in the bar code horizontally, that is, the bar-code reader scanning direction. Therefore, a high printing quality is required in printing the bar code. However, the printer 1 in the first embodiment is very useful because this printer is relatively cheap but can print the bar code without using an especially high-quality and thus costly printing technology.

Operation of the first embodiment will now be described with specific numerical value examples. The printing width 'H' of the head unit 17 corresponds to 24 dots.

The bit-pattern producing LSI circuit 26 develops three lines of data from first to third lines from the top of a first sheet in the in-apparatus memory 28 having a size of 1920 dots along a vertical direction by 2176 dots along a horizontal direction. Then, the first line is printed with the width 'h1' shown in FIG. 4A. If a required line feed dot number to the top of the subsequent line is more than 25 dots and also a vertical length of the dot pattern corresponds to a dot number more than 25 dots, after the printing of the first line with the width 'h1', the remaining part of the first line and a part of the second line are printed with the width 'h2' shown in FIG. 4A. In this case, .before the printing with the width 'h2' and after the printing with the width 'h1' indicating the width corresponding to 24 dots, the correction processing unit 29 in the line control unit 27 copies data from the top of the subsequent line (second line) having a size of 24 dots in the vertical direction by 2176 dots in the horizontal direction in a turnout area of the in-apparatus memory 28. After the copying of the data, the correction processing unit 29 deletes original data from the second dots (second row of dots) from the top dots (top row of dots) of the subsequent line (second line) having a size of 23 dots in the vertical direction by 2176 dots in the horizontal direction from the in-apparatus memory 28. Further, the program manager 12, via the apparatus control unit 16, controls the sheet feed mechanism 18 so as to feed the sheet for an 18/120 inch line feed.

Then, when the second line is printed, the head unit 17 scans the width 'h2' including the remaining dot part of the first line and the top first dots (the top row of dots) in the second line at the same time. Then, the program manager 12, via the apparatus control unit 16, controls the sheet feed mechanism 18 so as to feed the sheet for a 2/120-inch slight line feed. As a result, the head unit 17 is located at a position at which the head unit 17 can print from the top of the second line with the width 'h3' shown in FIG. 4A.

Then, the correction processing unit 29 in the line control unit 27 returns the data which was copied in the turnout area to an original position in the in-apparatus memory 28. Then, the program manager 12, via the apparatus control unit 16, controls the head unit 17 so that the head unit 17 scans the width 'h3' and thus prints out the data having the size of 24 dots in the vertical direction by 2176 dots in the horizontal direction.

If no error occurs when the sheet feed mechanism 18 feeds the sheet for the 2/120-inch slight line feed, by the above-described series of operations, the first dots (the top row of dots) in the second line are printed twice in the same part. The twice-printed part, indicated by a bold horizontal line 'Q' in FIG. 4B, therefore becomes somewhat dark in comparison to the other part. However, when a bar code is printed, it is advantageous that a substantially problematic matter that a gap such as the gap 'G' shown in FIG. 2A is included in the printed bar code can be prevented although the printed bar code includes a somewhat darker part. In the first embodiment, even if an error 'E' shown in FIG. 4A occurs when the sheet feed mechanism 18 feeds the sheet for the 2/120-inch slight line feed and thus the sheet is fed excessively by one dot, the above-mentioned twice printing of the first dots prevents a gap from appearing. Thus, a high-quality printing can be achieved. If an error occurs when the sheet feed mechanism 18 feeds the sheet for the 2/120-inch slight line-feed and thus the sheet is fed a shorter width by one dot, the above-mentioned twice-printed part, that is, the somewhat darker part, is widened but no gap appears in the printed bar code and so forth. Thus, a high-quality printing can be achieved.

Figure 5:
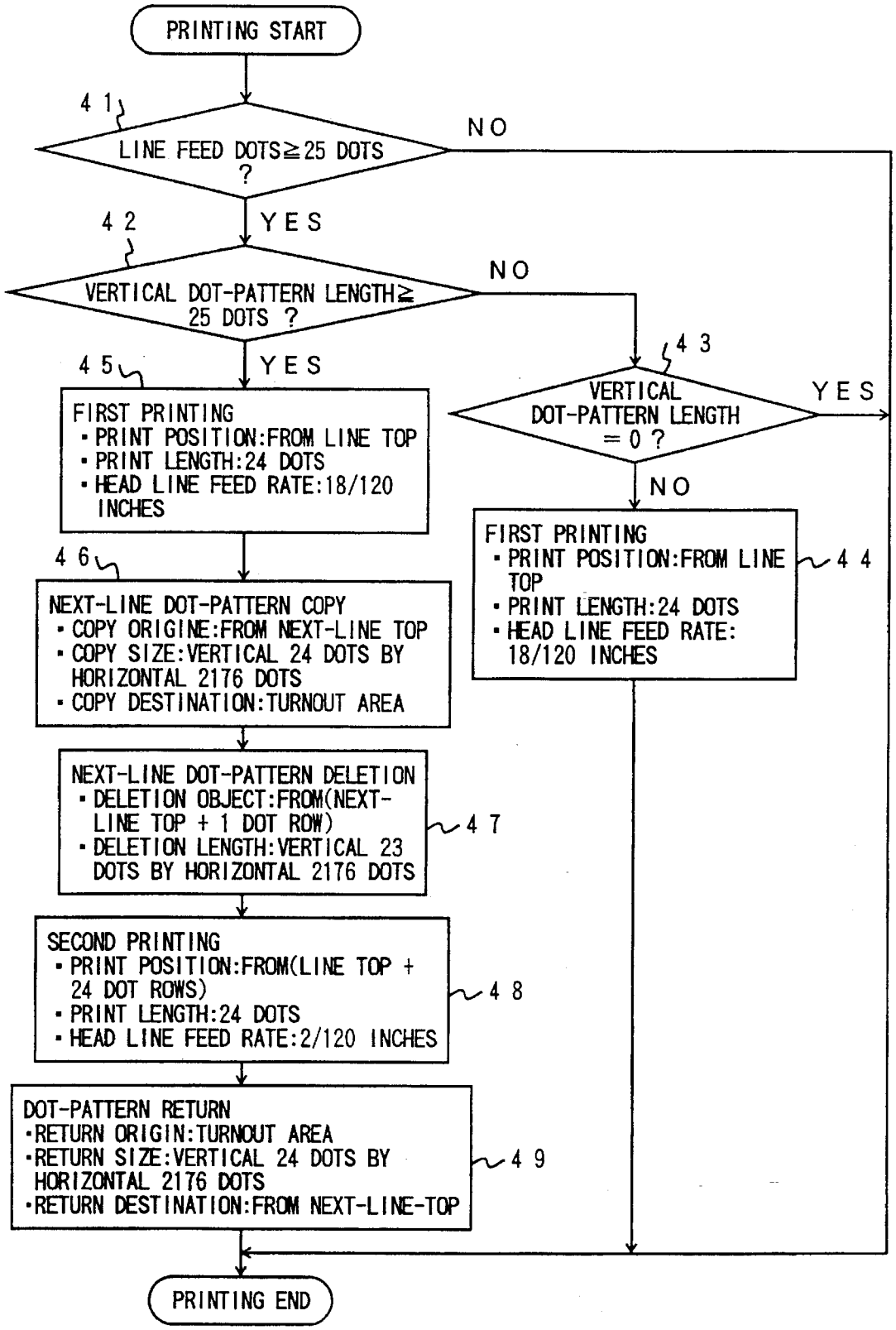
FIG. 5 shows a flowchart of an operation of the first embodiment.

FIG. 5 shows a flowchart illustrating the operation of the first embodiment. In a step 41, it is determined whether or not a width which the sheet is fed in the first line feed corresponds to a number of dots equal to or more than 25 dots. If a determination result is 'NO', the process is terminated. If a determination result of the step 41 is 'YES', it is determined in a step 42 whether or not a vertical length of data to be printed out corresponds to a number of dots equal to or more than 25 dots. If the determination result of the step 42 is 'NO', it is determined in a step 43 whether or not the vertical length of the data to be printed corresponds to a number of dots equal to 0. It a determination result is 'YES', the process is terminated. If the determination result in the step 43 is 'NO', a step 44 performs a first printing operation, and then the process is terminated. In this case, a print position is a position starting from the top of the line, a print length is 24 dots, and a line feed rate of the head unit 17 is 18/120 inches.

If the determination result of the step 42 is 'YES', a step 45 performs the first printing operation. In this case, the print position is a position starting from the top of the line, the print length is 24 dots, and the line feed rate of the head unit 17 is 18/120 inches. In a step 46, dot patterns of a subsequent line are copied. In this case, a copy origin is a part starting from the top of the subsequent line, a copy size is 24 vertical dots by 2176 horizontal dots, and a copy destination is the turnout area in the in-apparatus memory 28. Further, a step 47 deletes dot patterns of the subsequent line. In this case, a deletion object is a part starting from a dot row, a number of which results from adding one to the number of the top dot row of the subsequent line, and a deletion size is 23 vertical dots by 2176 horizontal dots.

A step 48 performs a second printing operation. In this case, the print position is a position starting from a dot row, a number of which results from adding 24 to the number of the top dot row of the line, the print length is 24 dots, and the line feed rate of the head unit 17 is 2/120 inches. A step 49 returns the copied dot patterns. In this case, a return origin is the turnout area in the in-apparatus memory 28, a return size is 24 vertical dots by 2176 horizontal dots, and a return destination is a position starting from the top of the subsequent line. Then, the process is terminated.

In the first embodiment, one dot row is overlaid in printing when no error occurs in the slight line feed. Thus, correction is performed so that, although the error of one dot row occurs, no gap may appear. However, the correction is not limited to that in which a number of dot rows which are overlaid in printing when no error occurs is 1. It is also possible to overlay a number of dot rows in printing, which number is more than one and equal to or less than a number of dots corresponding to the maximum width 'o1' shown in FIG. 4B in the correction. Thereby, the error of a number of dots corresponding to the maximum width 'o1' can be corrected. However, because the overlaid part is printed darker than the other part, it is preferable, in a case where letters or the like other than bar codes are printed, that a number of dot rows to be overlaid in printing is within a range approximately between 1 through 5.

Figure 6:
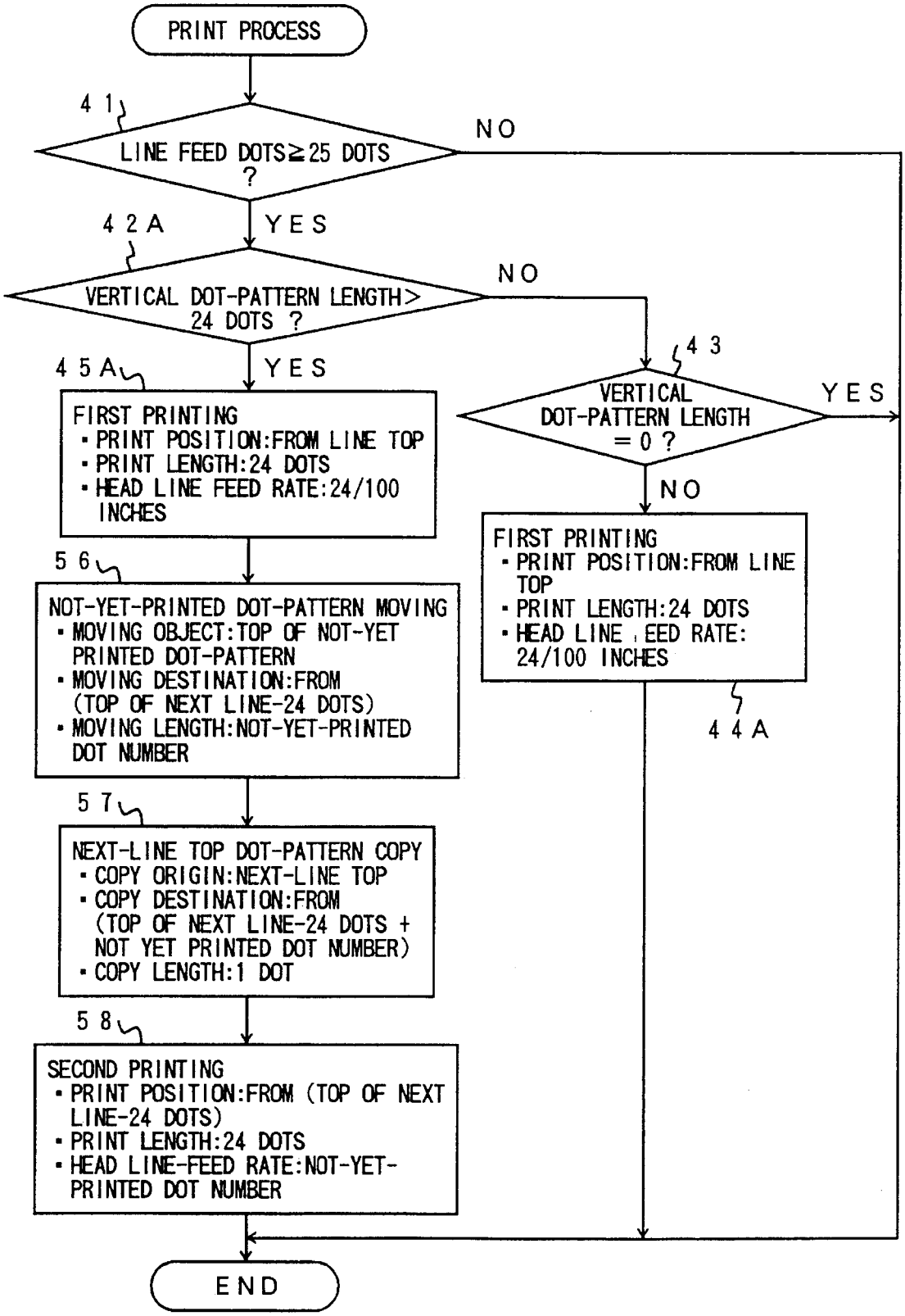
FIG. 6 shows a flowchart of an operation of a second embodiment of a printer according to the present invention.

A second embodiment of the printer according to the present invention will now be described. The second embodiment of the printer uses a second embodiment of the printing control method according to the present invention. A structure of a printer in the second embodiment may be the same as the structure of the printer in the above-described first embodiment. FIG. 6 shows a flowchart illustrating an operation of the second embodiment. The same reference numerals are given to steps the same as those shown in FIG. 5.

In FIG. 6, in a step 41, it is determined whether or not a width which the sheet is fed in the first line feed corresponds to a number of dots equal to or more than 25 dots. If a determination result is 'NO', the process is terminated If a determination result of the step 41 is 'YES', it is determined in a step 42A whether or not a vertical length of data to be printed out corresponds to a number of dots more than 24 dots. If the determination result of the step 42A is 'NO', it is determined in a step 43 whether or not the vertical length of the data to be printed corresponds to a number of dots equal to 0. It a determination result is 'YES', the process is terminated. If the determination result in the step 43 is 'NO', a step 44A performs a first printing operation, and then the process is terminated. In this case, a print position is a position starting from the top of the line, a print length is 24 dots, and a line feed rate of the head unit 17 is 24/120 inches.

If the determination result of the step 42A is 'YES', a step 45A performs the first printing operation. In this case, the print position is a position starting from the top of the line, the print length is 24 dots, and the line feed rate of the head unit 17 is 24/120 inches. Further, a step 56 moves dot patterns which have not been printed in the in-apparatus memory 28. In this case, a moving object is a part starting from the top of the not-yet-printed dot patterns, a moving destination is a position starting from a dot row, a number of which results from subtracting 24 from the number of the top dot row of a subsequent line, and a moving length is the number of dots of the not-yet-printed dot patterns. Further, a step 57 copies dot patterns at the top of the subsequent line in the in-apparatus memory 28. In this case, a copy origin is a part starting from the top of the subsequent line, a copy destination is a position starting from a dot row, a number of which results from subtracting 24 from the number of the top dot row of the subsequent line and then adding thereto a number of dot rows of the not-yet-printed dot patterns, and a copy length corresponds to one dot.

A step 58 performs a second printing operation. In this case, the printing position, that is, a position in the in-apparatus memory 28 from which dot patterns are read out and then printed out on the sheet, is a position starting from a dot row, a number of which results from subtracting 24 from the number of the top dot row of the subsequent line. The printing length corresponds to 24 dots, and the line feed rate of the head unit 17 corresponds to a number of dot rows of the not-yet-printed dot patterns. Then, the process is terminated.

Thus, in the second embodiment, when a line-feed number of dots for the subsequent line is equal to or more than 25 dots and also the printing dot-pattern vertical length is more than 24 dots, a process which will now be described with reference to FIGS. 7A, 7B, 7C, 8A, 8B and 8C is performed. FIGS. 7A, 7B, 7C, 8A, 8B and 8C illustrate data storage states and printed sheet states in each step of the process.

Figure 7A:
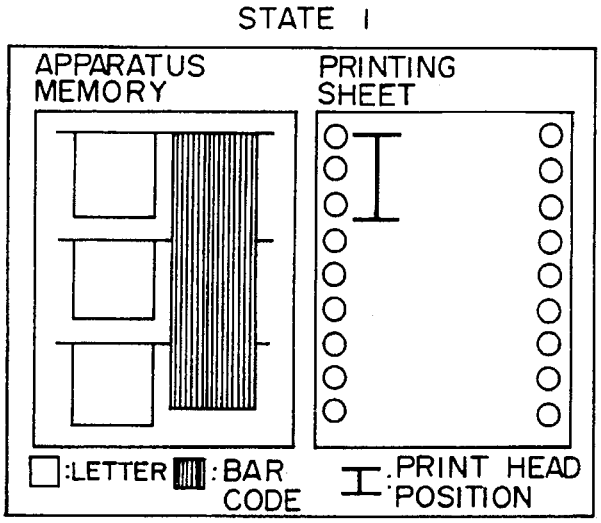
FIGS. 7A, 7B, 7C, 8A, 8B and 8C illustrate an operation of the second embodiment.

In a state 1 shown in FIG. 7A, dot patterns of three lines from a specified line or the top of a sheet are developed in the in-apparatus memory 28.

Figure 7B:
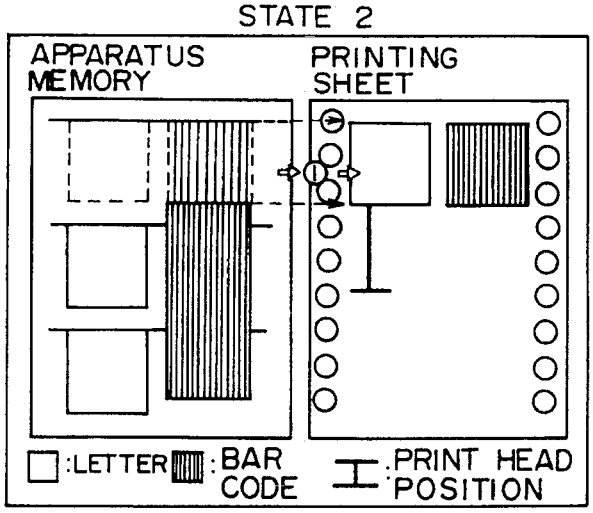

In a state 2 shown in FIG. 7B, the first printing is performed, thus dot patterns of 24 dot rows from the top of the first line are printed, and then 24-dit line feed of the head unit 17 is performed.

Figure 7C:
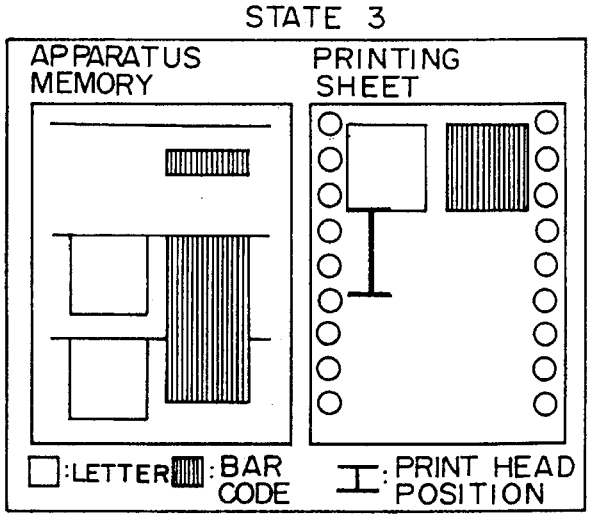

In a state 3 shown in FIG. 7C, a partial dot pattern, in the first-line dot pattern, which has not been printed yet in the first printing, that is, a dot pattern of [(the line-feed dot-number for a subsequent line)-24] vertical dots by 2448 horizontal dots is moved to a position starting from a dot row, a number of which results from subtracting 24 from the number of the top dot row of the second line in the in-apparatus memory 28.

Figure 8A:
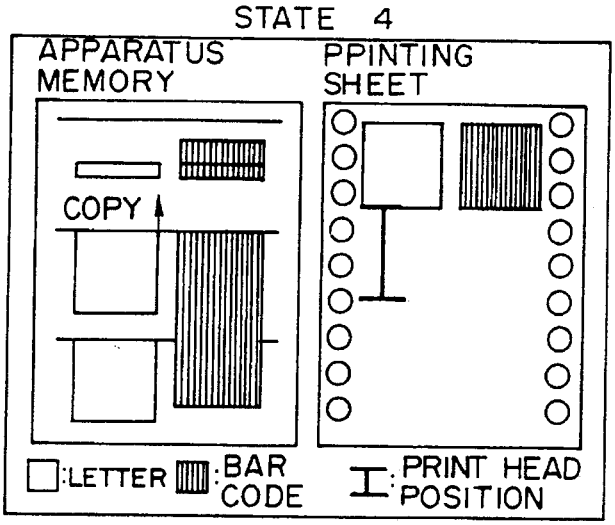

In a state 4 shown in FIG. 8A, a dot row of vertical 1 by horizontal 2448 dots from the top of the second line is copied immediately beneath the dot pattern which was moved in the state 3. Thus, when the gap correction of one dot width is performed, one dot row of dot pattern from the top of the second line is copied to a position starting from a dot row, a number of which results from subtracting 24 from the number of the top dot row of the second line and then adding thereto a number of dot rows of the not-yet-printed dot pattern in the first line of dot pattern in the in-apparatus memory 28.

Figure 8B:
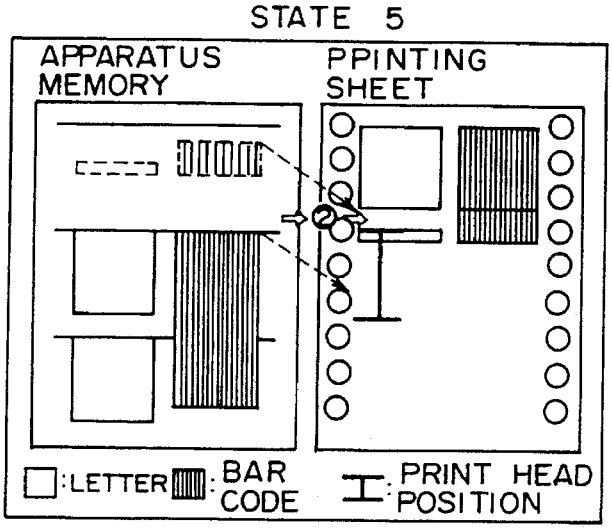

Then, in a state 5 shown in FIG. 8B, in a second printing operation, the dot patterns produced in the above states 3 and 4 in the in-apparatus memory 28 are printed from a position in the in-apparatus memory 28 starting from a dot row, a number of which results from subtracting 24 from the number of the top dot row of the second line. Then, a slight line feed of the head unit 17 by the number of dot rows of the not-yet-printed dot pattern is performed. The second printing operation is performed so that the top dot row of the second line which was copied in the state 4 may fill up a position at which a gap such as that described above may appear due to a possible error occurring in the slight line feed of the head unit. Then, a third printing operation by the head unit 17 is performed.

Figure 8C:
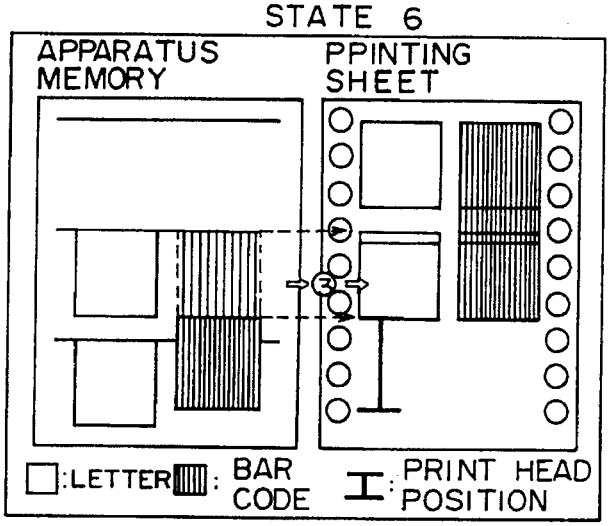

In a state 6 shown in FIG. 8C, the 24-dit line feed of the head unit 17 is performed. Then, dot patterns remaining of the second line will be printed in a fourth printing operation. By performing steps similar to those of the above states 2 through 4 for each of the subsequent lines, the subsequent lines will be printed.

Figure 9:
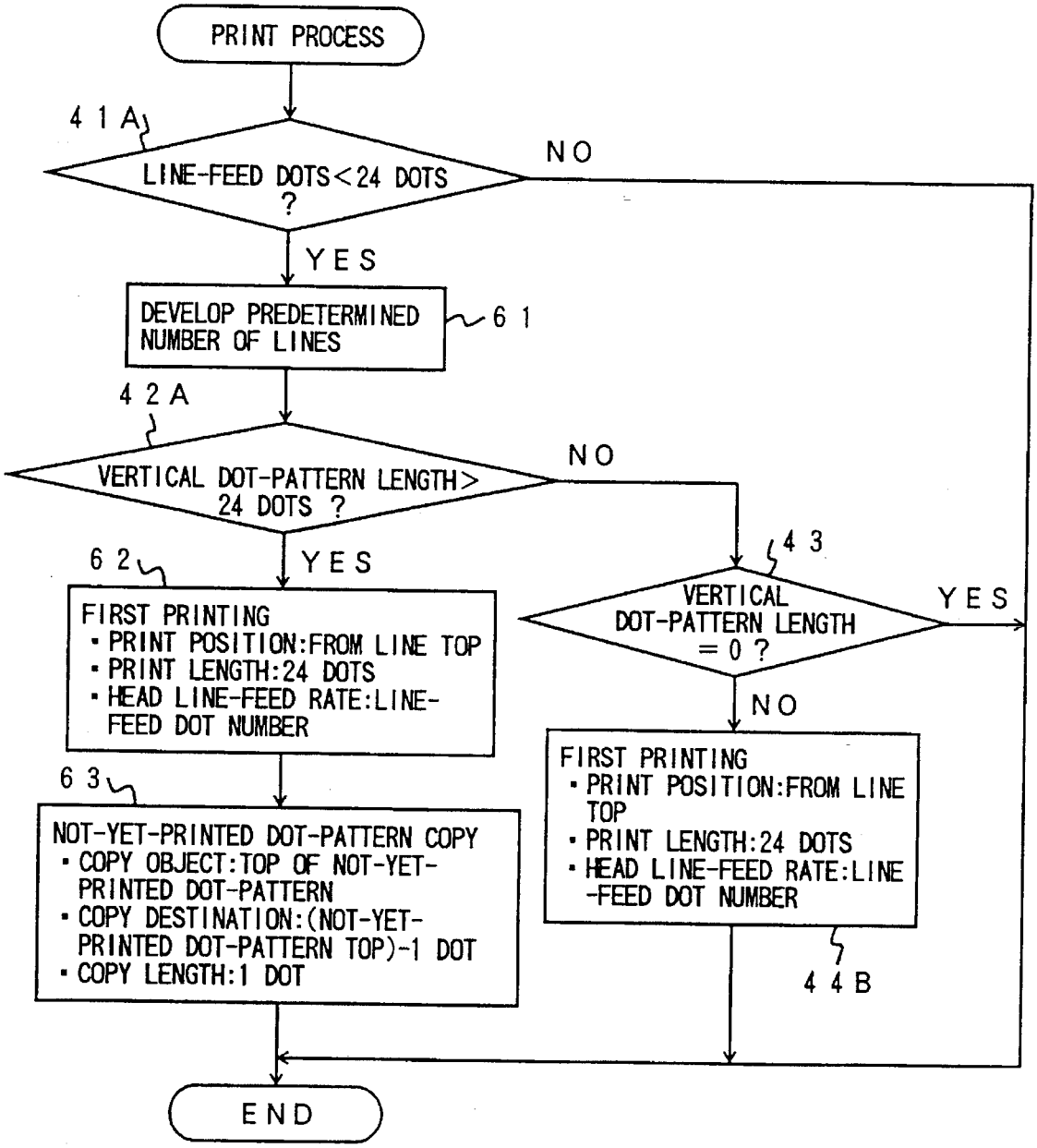
FIG. 9 shows a flowchart of an operation of a third embodiment of a printer according to the present invention.

A third embodiment of the printer according to the present invention will now be described. The third embodiment of the printer uses a third embodiment of the printing control method according to the present invention. A structure of a printer in the third embodiment may be the same as the structure of the printer in the above-described first embodiment. FIG. 9 shows a flowchart illustrating an operation of the third embodiment. The same reference numerals are given to steps the same as those shown in FIG. 6.

In FIG. 9, in a step 41A, it is determined whether or not a width which the sheet is fed in the first line feed corresponds to a number of dots less than 24 dots If a determination result is 'NO', the process is terminated. If a determination result of the step 41A is 'YES', a step 61 develops a predetermined number of lines of dot patterns in the in-apparatus memory 28. Then, it is determined in a step 42A whether or not a vertical length of data to be printed out corresponds to a number of dots more than 24 dots. If the determination result of the step 42A is 'NO', it is determined in a step 43 whether or not the vertical length of the data to be printed corresponds to a number of dots equal to 0. It a determination result is 'YES', the process is terminated. If the determination result in the step 43 is 'NO', a step 44B performs a first printing operation, and then the process is terminated. In this case, a print position is a position starting from the top of the line, a print length is 24 dots, and a line feed rate of the head unit 17 corresponds to an ordinary line-feed dot number.

If the determination result of the step 42A is 'YES', a step 62 performs a first printing operation. In this case, a print position is a position starting from the top of the line, a print length is 24 dots, and a line feed rate of the head unit 17 corresponds to the ordinary line-feed dot number. Further, a step 63 copies part of the dot patterns, which have not been printed yet in the first printing operation, in the in-apparatus memory 28. In this case, a copy origin is the top row of the not-yet printed dot patterns, a copy destination is a position immediately above the top dot row of the not-yet-printed dot patterns and the copy length is one dot.

Thus, in the third embodiment, when a line-feed dot number for the subsequent line is less than 24 dots and also the printing dot-pattern vertical length is more than 24 dots, a process which will now be described with reference to FIGS. 10A, 10B, 10C, 11A and 11B is performed. FIGS. 10A, 10B, 10C, 11A and 11B illustrate data storage states and printed sheet states in each step of the process.

Figure 10A:
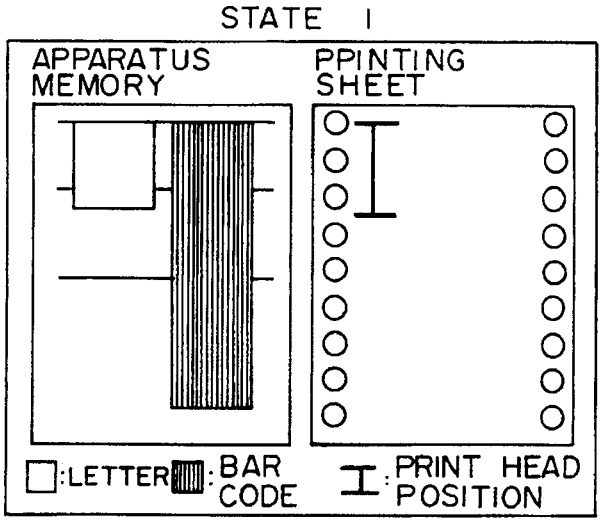
FIGS. 10A, 10B, 10C, 11A, and 11B illustrate an operation of the third embodiment.

In a state 1 shown in FIG. 10A, a predetermined number of lines of dot patterns of a letter and a bar code from a specified first line or the top line of a sheet are developed in the in-apparatus memory 28.

Figure 10B:
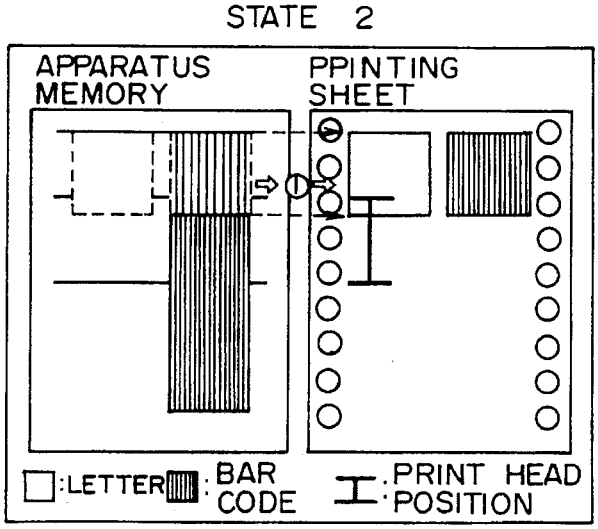

In a state 2 shown in FIG. 10B, the first printing operation is performed. Thus, dot patterns of 24 dot rows from the top of the first line are printed, and then a line feed of the head unit 17 is performed to the top of the second line.

Figure 10C:
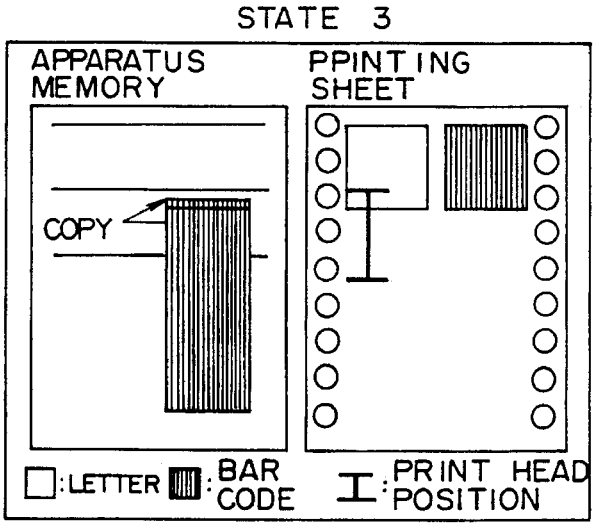

In a state 3 shown in FIG. 10C, a top partial dot pattern of the dot pattern of bar code which has not been printed yet in the first printing operation, specifically, a dot pattern of one vertical dot by 2448 horizontal dots is copied to a position immediately above the top dot row of the not-yet-printed dot pattern, that is, a position of a dot row, a number of which results from subtracting one from the number of the top dot row of the not-yet-printed dot pattern, in the in-apparatus memory 28.

Figure 11A:
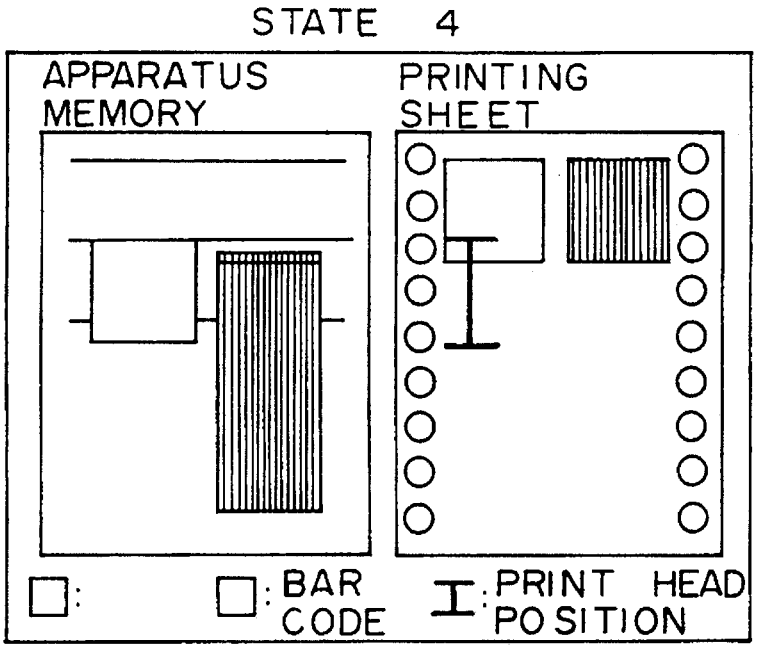

In a state 4 shown in FIG. 11A, a predetermined number of lines of dot pattern is developed from the top of the second line in the in-apparatus memory 28.

Figure 11B:
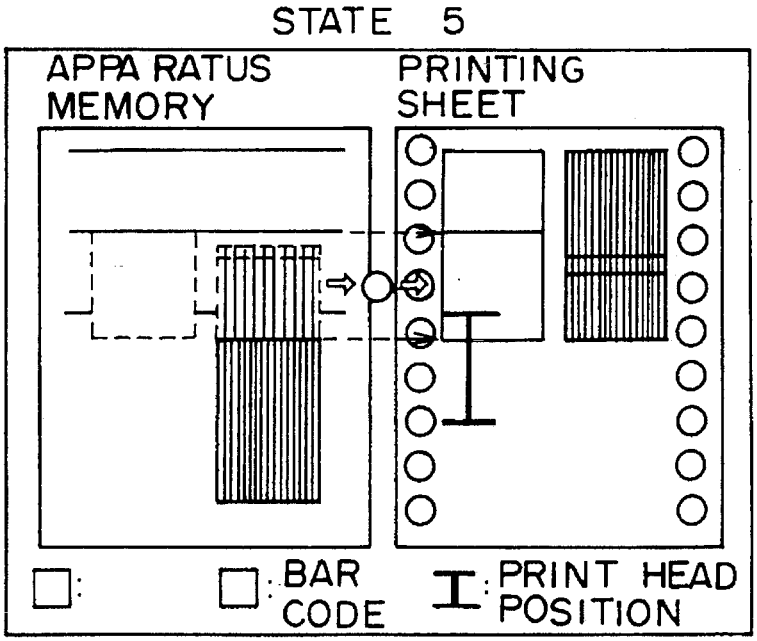

Then, in a state 5 shown in FIG. 11B, in a second printing operation, the dot patterns produced in the above states 3 and 4 in the in-apparatus memory 28 are printed so that the dot row which was obtained as a result of the copy in the state 3 may fill in a position at which a gap may appear due to a possible error occurring in the line feed in the state 2. Then, a line feed of the head unit 17 is performed to the top of the subsequent line (third line).

Then, as a result of repeating a series of steps similar to those of the states 2 through 4 for each of subsequent lines, the subsequent lines will be printed.

Figure 12:
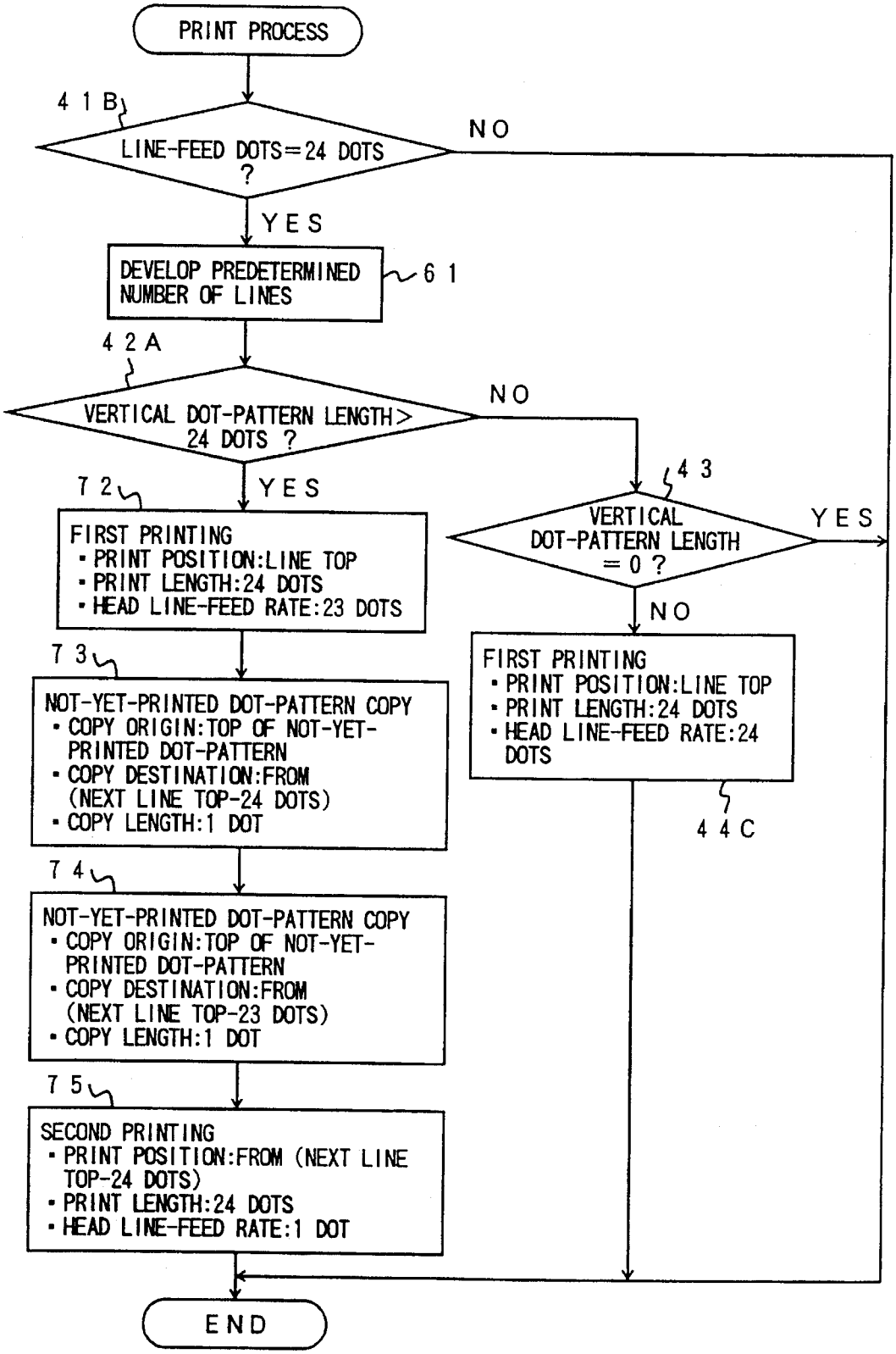
FIG. 12 shows a flowchart of an operation of a fourth embodiment of a printer according to the present invention.

A fourth embodiment of the printer according to the present invention will now be described. The fourth embodiment of the printer uses a fourth embodiment of the printing control method according to the present invention. A structure of a printer in the fourth embodiment may be the same as the structure of the printer in the above-described first embodiment. FIG. 12 shows a flowchart illustrating an operation of the fourth embodiment. The same reference numerals are given to steps the same as those shown in FIG. 6.

In FIG. 12, in a step 41B, it is determined whether or not a width which the sheet is fed in the first line feed corresponds to a number of dots equal to 24 dots. If a determination result is 'NO', the process is terminated. If a determination result of the step 41B is 'YES', a step 61 develops a predetermined number of lines of dot patterns in the in-apparatus memory 28. Then, it is determined in a step 42A whether or not a vertical length of data to be printed out corresponds to a number of dots more than 24 dots. If the determination result of the step 42A is 'NO', it is determined in a step 43 whether or not the vertical length of the data to be printed corresponds to a number of dots equal to 0. It a determination result is 'YES', the process is terminated. If the determination result in the step 43 is 'NO', a step 44A performs a first printing operation, and then the process is terminated. In this case, a print position is a position starting from the top of the line, a print length corresponds to 24 dots, and a line feed rate of the head unit 17 corresponds 24 dots.

If the determination result of the step 42A is 'YES', a step 72 performs a first printing operation. In this case, a print position is a position starting from the top of the line, a print length corresponds to 24 dots, and a line feed rate of the head unit 17 corresponds to 23 dots. Further, a step 73 copies part of the dot patterns, which have not been printed yet in the first printing operation, in the in-apparatus memory 28. In this case, a copy origin is the top row of the not-yet-printed dot patterns, a copy destination is a position of a dot row, a number of which results from subtracting 24 from the number of the top dot row of the not-yet-printed dot pattern, and the copy length is one dot. Further, a step 74 copies the same part of the dot patterns, which have not been printed yet in the first printing operation, in the in-apparatus memory 28. In this case, a copy origin is the top row of the not-yet-printed dot patterns, a copy destination is a position of a dot row, a number of which results from subtracting 23 from the number of the top dot row of the not-yet-printed dot pattern, and the copy length is one dot.

A step 75 performs a second printing operation. In this case, a print position is a position starting from a dot row, a number of which results from subtracting 24 from the number of the top dot row of the subsequent line, a print length corresponds to 24 dots, and a line feed rate of the head unit 17 corresponds to one dot. Then, the process is terminated.

Thus, in the fourth embodiment, when a line-feed dot number for the subsequent line is equal to 24 dots and also the printing dot-pattern vertical length is more than 24 dots, a process which will now be described with reference to FIGS. 13A, 13B, 13C, 14A, 14B and 14C is performed. FIGS. 13A, 13B, 13C, 14A, 14B and 14C illustrate data storage states and printed sheet states in each step of the process.

Figure 13A:
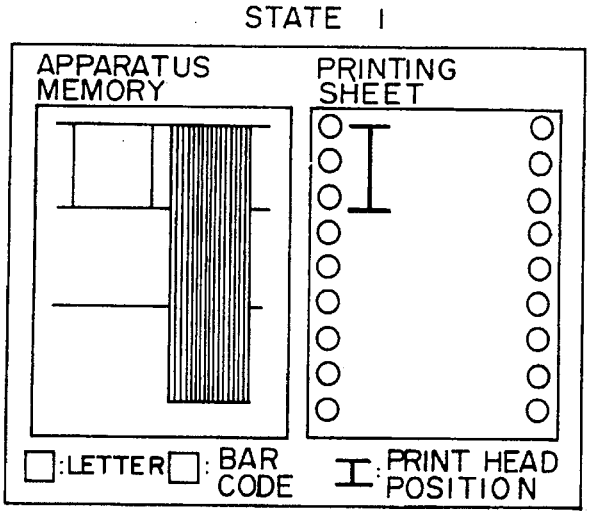
FIGS. 13A, 13B, 13C, 14A, 14B and 14C illustrate an operation of the fourth embodiment.

In a state 1 shown in FIG. 13A, a predetermined number of lines of dot patterns of a letter and a bar code from a specified first line or the top line of a sheet are developed in the in-apparatus memory 28.

Figure 13B:
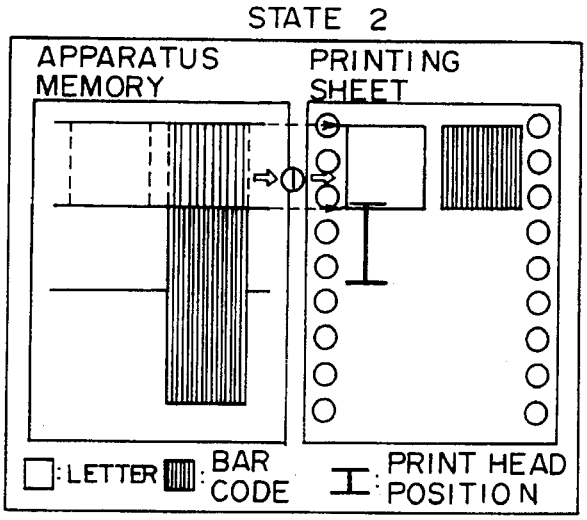

In a state 2 shown in FIG. 13B, the first printing is performed, thus dot patterns of 24 dot rows from the top of the first line are printed, and then a 23-dot line feed of the head unit 17 is performed.

Figure 13C:
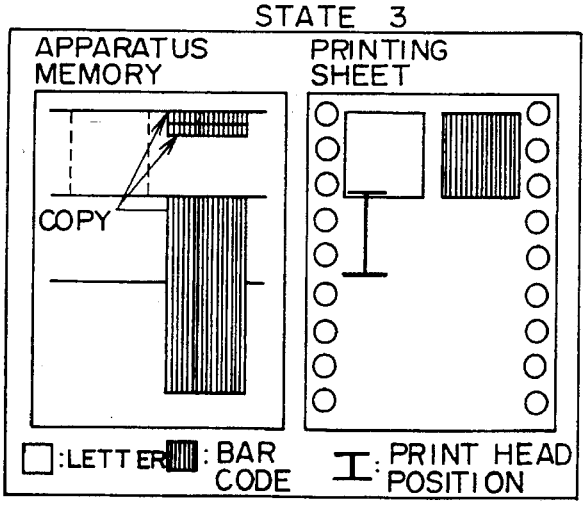

In a state 3 shown in FIG. 13C, a top partial dot pattern of the dot pattern of bar code which has not been printed yet in the first printing, specifically, a dot pattern of one vertical dot by 2448 horizontal dots is copied to a position, in the in-apparatus memory 28, starting from a dot row, a number of which results from subtracting 24 from the number of the top dot row of the not-yet-printed dot pattern, and also a position starting from a dot row, a number of which results from subtracting 23 from the number of the top dot row of the not-yet-printed dot pattern.

Figure 14A:
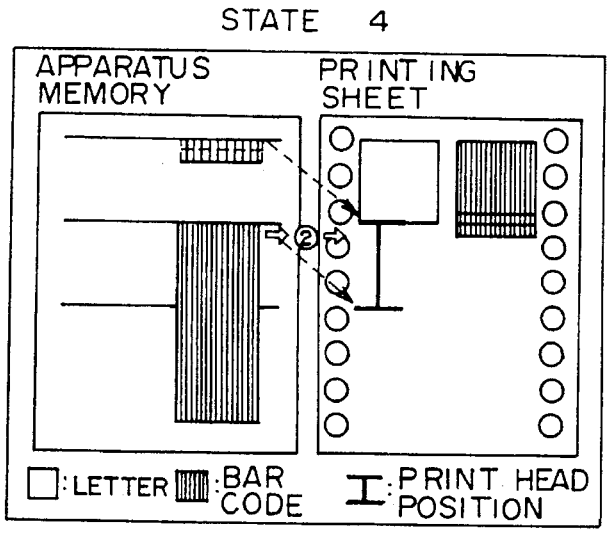

Then, in a state 4 shown in FIG. 14A, in a second printing operation, the dot patterns produced in the above states 3 in the in-apparatus memory 28 are printed. Then, a one-dot slight line feed of the head unit 17 is performed. In the second printing operation, the printing is performed so that a top one of the two dot rows which were obtained as a result of the copy in the state 3 may fill in a position at which a gap may appear due to a possible error occurring in the line feed in the state 2, and the bottom one of the obtained two dot rows may fill in a position at which a gap may appear due to a possible error occurring in the above-mentioned one-dot slight line feed in the state 4.

Figure 14B:
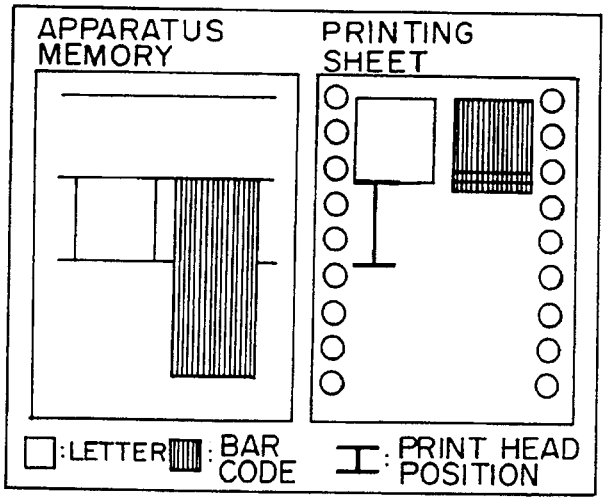

In a state 5 shown in FIG. 14B, a predetermined number of lines of dot pattern are developed from the top of the second line in the in-apparatus memory 28.

Figure 14C:
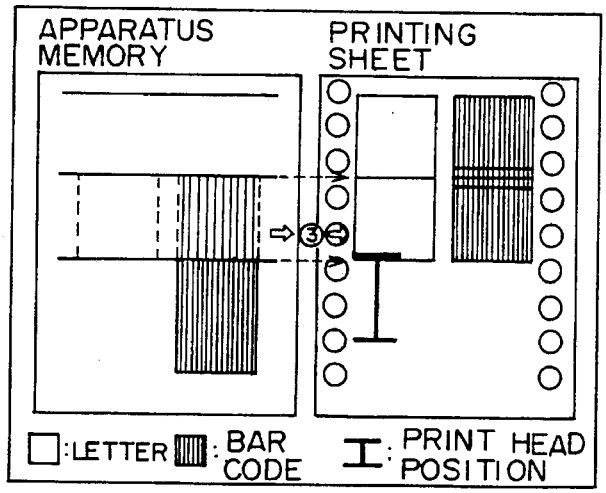

In a state 6 shown in FIG. 14C, the second line is printed in a manner similar to the case of printing of the first line. Then, by performing steps similar to those in the states 1 through 5 for each of subsequent lines, the subsequent lines will be printed.

By the above-described second through fourth embodiments, it is possible to reduce, to the limit in comparison to the first embodiment, processes of copying, to the turnout area, dot patterns developed in the in-apparatus memory 28 in the printing operation, of deleting dot patterns developed in the in-apparatus memory 28, and of returning dot patterns previously copied to the turnout area. Further, a vertical width of a dot pattern which is printed for filling in a possible gap is not limited to a width corresponding to one dot. The width of the dot pattern may be a width corresponding to a plurality of dots. It is preferable that a vertical width of a dot pattern which is printed for filling in a possible gap is a width corresponding to one selected from 1 through 5 dots.

Further, an application of the above-described embodiments is not limited to one for printing bar codes and letters, and the embodiments may be similarly applied for printing magnified letters, various figures, and various images. In any cases of application, degradation of printing quality due to a low line feed accuracy can be surely prevented. Further, because the embodiments can correct, at a high speed, horizontally extending gaps appearing due to a low line feed accuracy, a high-quality printing at a high speed can be achieved. Further, even if a line feed accuracy is degraded due to use over a long period, degradation of printing quality can be prevented.

Further, each embodiment uses a mechanism in which a sheet is fed with respect to the head unit. However, embodiments of the present invention are not limited to those using such a mechanism, and the present invention can be applied to embodiments having a mechanism in which a spatial relationship between a sheet and the head unit varies and thus the head unit prints dot patterns onto the sheet.

Further, the present invention is especially effective when being applied to impact printers, but application of the present invention is not limited to the impact printers. In principle, the present invention can be applied to various printers such as ink-jet printers, thermal printers, and so forth.

Further, the present invention is not limited to the above-described embodiments, and variations and modifications may be made without departing from the scope of the present invention.

What is claimed is:

1. A printing method for printing lines on a sheet using a head unit, said lines having a pitch larger than a printing width of said head unit, said printing width being a width along a first direction, said method comprising steps of:

a) printing using said head unit on said sheet a first part of a first line along a second direction perpendicular to said first direction;

b) moving a relative position of said head unit with reference to said sheet along said first direction a distance equal to said printing width of said head unit;

c) printing using said head unit on said sheet a remaining part of said first line and at least a first part of a second line along said second direction;

d) moving said relative position of said head unit with reference to said sheet along said first direction a slight distance equal to or shorter than said printing width of said head unit; and e) printing using said head unit on said sheet a predetermined part of said second line along said second direction, said predetermined part including said first part of said second line.

2. The printing method according to claim 1, wherein:

said relative position of said head unit with reference to said sheet moves a distance longer than a predetermined distance 'M' along said first direction in an ordinary line feed case, said printing width of said head unit being expressed by N=M−C, where M>N>C and 'C' indicates a correction width along said first direction; and said method further comprises steps of:

f) determining, when a first printing operation is performed, that a printing starting position of said head unit is to be a top of said first line and said printing width is to be equal to 'N';

g) determining, when a not-yet-printed pattern in a memory is moved to a free area of said memory, that a moving object is to be one starting from a top of said not-yet-printed pattern of said first line and a moving object length is to be a not-yet-printed width of said first line;

h) determining, when a top printing pattern in said second line is copied to a free area of said memory, that a copy object is to be one starting from a top of said second line and a copy destination is to be a position resulting from adding said not-yet-printed width of said first line to a top of said not-yet-printed pattern of said first line which was moved, and a copy object length is to be 'C'; and i) determining, when a second printing operation is performed, that a printing starting position is to be one resulting from subtracting said not-yet-printed width of said first line from a top of a subsequent line, and a line feed rate of said head unit is to correspond to said not-yet-printed width of said first line.

3. The printing method according to claim 1, wherein:

said relative position of said head unit with reference to said sheet moves a distance equal to a predetermined distance 'M' along said first direction in an ordinary line feed case, 'C' indicates a correction width along said first direction, 'L' indicates a printable maximum width along said second direction in each line, and M>C; and said method further comprises steps of:

f) developing in a memory a predetermined number of lines of printing patterns, said predetermined number of lines starting from a specified top line or a top of said sheet;

g) printing 'M' of said printing patterns from a top of said specified first line in a first printing operation, and performing a line feed of said head unit to a top of a subsequent line;

h) copying a size of along-said-first-direction (vertical) 'C' by along-said-second-direction (horizontal) 'L' of said printing patterns which have not been printed in said first printing operation, to a position, in said memory, resulting from subtracting 'C' from a top of said printing patterns which have not been printed in said step g);

i) developing printing patterns of a second line in said memory; and j) printing said printing patterns produced in said steps h) and i) in a second printing operation and performing a line feed of said head unit to a top of a subsequent line, so as to performing printing to fill in a gap which may appear due to a possible error occurring in said line feed in said step g).

4. The printing method according to claim 1, wherein:

said relative position of said head unit with reference to said sheet moves a distance equal to a predetermined distance 'M' along said first direction in an ordinary line feed case, said printing width of said head unit along said first direction being expressed by N=M, 'L' indicates a printable maximum width along said second direction in each line, 'C' indicates a correction width along said first direction, and and M>C; and said method further comprises steps of:

f) developing in a memory a predetermined number of lines of printing patterns, said predetermined number of lines starting from a specified top line or a top of said sheet;

g) printing 'M' of said printing patterns from a top of said specified first line in a first printing operation, and performing a line feed of said head unit by a distance of a length resulting from subtracting 'C' from 'M';

h) copying a size of along-said-first-direction (vertical) 'C' by along-said-second-direction (horizontal) 'L' of said printing patterns which have not been printed in said first printing operation, to a position, in said memory, resulting from subtracting 'M' from a top of said printing patterns which have not been printed in said step g), and further to a position resulting from subtracting 'M' from a top of said printing patterns which have not been printed in said step g) and adding 1 thereto;

i) printing said printing patterns produced in said step h in a second printing operation and performing a slight line feed of said head unit by a distance equal to 'C', so as to perform printing to fill in a gap which may appear due to a possible error occurring in said line feed in said step g and further fill in a gap which may appear due to a possible error occurring in said slight line feed in said step i;

j) developing printing patterns of a second line in said memory; and k) printing said second line similar to a manner in which said first line was printed.

5. A printer comprising:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein said control means, when lines are printed, said lines having a pitch larger than a printing width along said first direction, causes said head unit to print on said sheet a first part of a first line along said second direction;

causes said mechanism to move said relative position of said head unit with reference to said sheet along said first direction a distance equal to said printing width of said head unit;

causes said head unit to print on said sheet a remaining part of said first line and at least a first part of a second line along said second direction;

causes said mechanism to move said relative position of said head unit with reference to said sheet along said first direction a slight distance equal to or shorter than said printing width of said head unit; and causes said head unit to print on said sheet a predetermined part of said second line along said second direction, said predetermined part including said first part of said second line.

6. The printer according to claim 5, further comprising memory means;

wherein said control means, when said remaining part of said first line and said at least a first part of said second line are printed, stores in said memory means only part of said data of said first part of said second line, which part of data is used for printing in an overlapping manner, and deletes a remaining part of said data.

7. A printer comprising:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished;

control means for controlling said head unit and said mechanism in response to said data from said converting means;

wherein, in a case where said relative position of said head unit with reference to said sheet moves a distance longer than a predetermined distance 'M' along said first direction in an ordinary line feed case, said printing width of said head unit being expressed by N=M−C, where M>N>C and 'C' indicates a correction width along said first direction;

said control means:

determines, when a first printing operation is performed, that a printing starting position of said head unit is to be a top of a first line and a printing length is to be equal to 'N';

determines, when a not-yet-printed pattern in memory means is moved to a free area of said memory means, that a moving object is to be one starting from a top of said not-yet-printed pattern of said first line and a moving object length is to be a not-yet-printed width of said first line;

determines, when a top printing pattern in a second line is copied to a free area of said memory means, that a copy object is to be one starting from a top of said second line and a copy destination is to be a position resulting from adding said not-yet-printed width of said first line to a top of said not-yet-printed pattern of said first line which was moved, and a copy object length is to be 'C'; and determines, when a second printing operation is performed, that a printing starting position is to be one resulting from subtracting said not-yet-printed width of said first line from a top of a subsequent line, and a line feed rate of said head unit is to correspond to said not-yet-printed width of said first line.

8. A printer comprising:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein, in a case where said relative position of said head unit with reference to said sheet moves a distance equal to a predetermined distance 'M' along said first direction in an ordinary line feed case, said printing width 'N', along said first direction, of said head unit being expressed by N>M, 'C' indicating a correction width along said first direction, 'L' Indicating a printable maximum width along said second direction in each line, and M>C;

said control means comprises:

first means for developing in memory means a predetermined number of lines of printing patterns, said predetermined number of lines starting from a specified top line or a top of said sheet;

second means for printing 'M' of said printing patterns from a top of said specified first line in a first printing operation, and performing a line feed of said head unit to a top of a subsequent line;

third means for copying a size of along-said-first-direction (vertical) 'C' by along-said-second-direction (horizontal) 'L' of said printing patterns which have not been printed in said first printing operation, to a position, in said memory means, resulting from subtracting 'C' from a top of said printing patterns which have not been printed by said second means;

fourth means for developing printing patterns of a second line in said memory means; and fifth means for printing said printing patterns produced by said third and fourth means in a second printing operation and performing a line feed of said head unit to a top of a subsequent line, so as to performing printing to fill in a gap which may appear due to a possible error occurring in said line feed by said second means.

9. A printer comprising:

converting means for converting a format of data appropriately so that said data may be printed;

a head unit for printing out said data from said converting means onto a sheet along a second direction perpendicular to a first direction;

a mechanism for changing a relative position of said head unit with reference to said sheet a predetermined distance each time one printing operation by said head unit is finished; and control means for controlling said head unit and said mechanism in response to said data from said converting means;

wherein, in a case where said relative position of said head unit with reference to said sheet moves a distance equal to a predetermined distance 'M' along said first direction in an ordinary line feed case, said printing width of said head unit along said first direction being expressed by N=M, 'L' indicating a printable maximum width along said second direction in each line, 'C' indicating a correction width along said first direction, and and M>C;

said control means comprises:

first means for developing in memory means a predetermined number of lines of printing patterns, said predetermined number of lines starting from a specified top line or a top of said sheet;

second means for printing 'M' of said printing patterns from a top of said specified first line in a first printing operation, and performing a line feed of said head unit by a distance of a length resulting from subtracting 'C' from 'M';

third means for copying a size of along-said-first-direction (vertical) 'C' by along-said-second-direction (horizontal) 'L' of said printing patterns which have not been printed in said first printing operation, to a position, in said memory means, resulting from subtracting 'M' from a top of said printing patterns which have not been printed by said second means, and further to a position resulting from subtracting 'M' from a top of said printing patterns which have not been printed by said second means and adding 1 thereto;

fourth means for printing said printing patterns produced by said third means in a second printing operation and performing a slight line feed of said head unit by a distance equal to 'C' so as to performing printing to fill in a gap which may appear due to a possible error occurring in said line feed by said second means and further fill in a gap which may appear due to a possible error occurring in said slight line feed by said fourth means;

fifth means for developing printing patterns of a second line in said memory means; and sixth means for printing said second line similar to a manner in which said first line was printed.

* * * * *